US009605454B2

(12) United States Patent
Ramsauer et al.

(10) Patent No.: US 9,605,454 B2
(45) Date of Patent: Mar. 28, 2017

(54) ROTARY LEVER LOCK

(71) Applicant: DIRAK Dieter Ramsauer Konstruktionselemente GmbH, Ennepetal (DE)

(72) Inventors: Dieter Ramsauer, Schwelm (DE); Matthias Velten, Much (DE)

(73) Assignee: DIRAK Dieter Ramsauer Konstruktionselemente GmbH, Ennepetal (DE)

( * ) Notice: Subject to any disclaimer, the term of this patent is extended or adjusted under 35 U.S.C. 154(b) by 0 days.

(21) Appl. No.: 14/787,829

(22) PCT Filed: Mar. 15, 2014

(86) PCT No.: PCT/EP2014/000694
§ 371 (c)(1),
(2) Date: Oct. 29, 2015

(87) PCT Pub. No.: WO2014/177237
PCT Pub. Date: Nov. 6, 2014

(65) Prior Publication Data

US 2016/0076283 A1 Mar. 17, 2016

(30) Foreign Application Priority Data

May 2, 2013 (DE) ..... 20 2013 004 046 U

(51) Int. Cl.
*E05B 65/00* (2006.01)
*E05C 5/00* (2006.01)
(Continued)

(52) U.S. Cl.
CPC ..... *E05C 3/004* (2013.01); *E05B 5/00* (2013.01); *E05B 33/00* (2013.01); *E05B 35/00* (2013.01);
(Continued)

(58) Field of Classification Search
CPC . E05B 5/00; E05B 5/003; E05B 33/00; E05B 57/00; E05B 63/06; E05C 3/00;
(Continued)

(56) References Cited

U.S. PATENT DOCUMENTS 1,027,397 A 5/1912 Adam
4,679,835 A * 7/1987 Weinerman ..... E05C 3/042 292/197

(Continued)

FOREIGN PATENT DOCUMENTS

| | | |
|---|---|---|
| CH | 553 903 | 9/1974 |
| EP | 1 723 299 | 4/2008 |
| GB | 906 388 | 9/1962 |

OTHER PUBLICATIONS

International Search Report (PCT/EP2014/000694) dated Jul. 1, 2014.

*Primary Examiner* — Christopher Boswell
(74) *Attorney, Agent, or Firm* — Frommer Lawrence & Haug LLP

(57) ABSTRACT

A rotary latch closure comprising a housing with an actuating shaft which is mounted so as to be rotatable, but axially fixed therein. The rotary latch closure has, at its free end, a circumferential thread, at least one axially oriented flattened portion, and a rotary latch configured to be fitted to the free end of the shaft so as to be fixed with respect to rotation relative to it in at least one rotational position and which is axially supported on a nut which can be screwed onto the circumferential thread. The nut is enclosed by a cage forming a laterally accessible space that is bounded by two walls, each of the two walls having a prismatic opening, wherein the opening allows the shaft to be slid through in a torsionally rigid manner.

11 Claims, 10 Drawing Sheets

(51) Int. Cl.

| | |
|---|---|
| ***E05C 3/00*** | (2006.01) |
| ***E05C 3/04*** | (2006.01) |
| ***E05B 57/00*** | (2006.01) |
| ***E05B 5/00*** | (2006.01) |
| ***E05B 33/00*** | (2006.01) |
| ***E05B 35/00*** | (2006.01) |
| ***E05B 41/00*** | (2006.01) |
| ***E05C 3/12*** | (2006.01) |
| ***E05C 3/14*** | (2006.01) |
| *E05B 63/06* | (2006.01) |
| *E05B 1/00* | (2006.01) |

(52) U.S. Cl.
CPC ..... *E05B 41/00* (2013.01); *E05B 57/00* (2013.01); *E05C 3/041* (2013.01); *E05C 3/042* (2013.01); *E05C 3/12* (2013.01); *E05C 3/145* (2013.01); *E05B 1/0092* (2013.01); *E05B 63/06* (2013.01)

(58) Field of Classification Search
CPC . E05C 3/004; E05C 3/04; E05C 3/041; E05C 3/042; E05C 3/043; E05C 3/12; E05C 3/14; E05C 3/145
IPC ..... E05B 57/00,63/06; E05C 3/004, 3/041, 3/145
See application file for complete search history.

(56) References Cited

U.S. PATENT DOCUMENTS

| | | | | |
|---|---|---|---|---|
| 4,823,571 | A * | 4/1989 | O'Gara | E05B 9/084 70/139 |
| 5,234,236 | A * | 8/1993 | Gromotka | E05B 63/0056 292/194 |
| 5,526,660 | A * | 6/1996 | Bennett | E05B 13/004 292/336.3 |
| 6,018,969 | A | 2/2000 | Haseley et al. | |
| 6,067,827 | A * | 5/2000 | Haseley | E05B 35/008 292/DIG. 60 |
| 7,360,381 | B1 * | 4/2008 | Leite | E05B 13/106 292/207 |
| 7,695,029 | B2 * | 4/2010 | Ramsauer | E05B 17/0025 292/63 |
| 8,118,334 | B2 * | 2/2012 | Ramsauer | E05C 3/042 292/194 |
| 8,459,703 | B2 * | 6/2013 | Anderson | E05B 63/0056 292/194 |
| 8,745,926 | B2 * | 6/2014 | De Domenico | E05B 35/008 49/465 |
| 2008/0036221 | A1 | 2/2008 | Ramsauer | |

* cited by examiner

ROTARY LEVER LOCK

The present application claims priority from PCT Patent Application No. PCT/EP2014/000694 filed on Mar. 15, 2014, which claims priority from German Priority Application No. 20 2013 004 046.7 filed on May 2, 2013, the disclosures of which are incorporated herein by reference in their entirety.

The invention is directed to an adjustable cam for a rotary latch closure, key closure, swivel lever closure and T-handle which comprises a housing with an actuating shaft which is mounted so as to be rotatable but axially fixed therein and which has at its free end a circumferential thread and at least one axially oriented flattened portion, and a rotary latch which can be fitted to the end of the shaft in at least one rotational position so as to be fixed with respect to rotation relative to it and which is axially supported on a nut which can be screwed onto the circumferential thread. A rotary latch closure of this type is known from EP 1 723 299 B1.

In the known rotary latch closure, swivel lever closure or key closure, a spring ensures that the rotary latch is held in a fixed position. However, a spring is a critical component part; it is prone to rust and laborious to install, particularly in switch cabinets which are to be provided with a closure. In switch cabinets of this kind, it is very risky to use any components made of metal as non-captive parts because this can lead to short-circuiting in a switch cabinet.

SUMMARY OF THE INVENTION

It is the object of the invention to avoid these disadvantages.

The above-stated object is met according to the invention in that the nut is enclosed by a cage forming a laterally accessible space that is bounded by two walls, each of the two walls having an opening which allows the shaft to be slid through in a torsionally rigid manner.

The rotary latch closure, particularly with actuation by means of a key, a swivel lever or T-handle, makes do without spring devices and is therefore well-suited for applications in which the spring could be lost during assembly.

According to an embodiment form of the invention, the cage is integral with the latch cam. Instead of this, the cage and the latch cam can also be two parts, which has the advantage that different materials can be used for the two parts, e.g., metal and plastic.

A rotary latch closure in which the cage is U-shaped and the walls of the cage form U-legs has proven especially successful. The one leg of the U-shaped cage can form a recess or projection near its free end in which a projection or recess of the rotary latch can be received in a positive engagement. The other leg of the U-shaped cage can form a knob which can engage with recesses in the contacting lateral surface of the nut for preventing rotation. This eliminates the risk of the nut moving out of its required position as the result of shaking. On the other hand, the other leg of the U-shaped cage can form a knob which engages with recesses in the contacting lateral surface of the nut in order to prevent rotation thereof. Tilting forces also result in preventing rotation of the nut.

When it is U-shaped, the cage can form a protrusion at its free end at the U-leg facing the housing, which protrusion cooperates with a path which is formed by the end of the housing and which has two stop faces for limiting the rotational path.

When the walls of the cage retract transverse to the extension of the latch and a knurling of the circumference of the nut is accordingly made accessible, the knurled nut can be more easily adjusted by the fingers.

It is also advantageous when the cage is U-shaped and the nut, together with the rotary latch, can be inserted into the cage along the axis of the U-leg.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

Figure 1D:
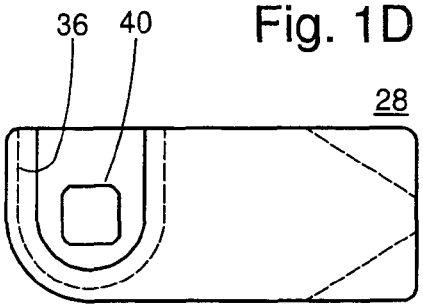
FIG. 1D shows a side view of the rotary latch in question.
Figure 1E:
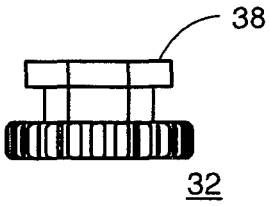
FIG. 1E shows a side view of the pinion shown in in FIG. 1A.
Figure 1C:
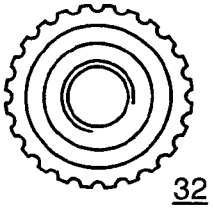
FIG. 1C shows a top view of a pinion which is shown in a side view in FIG. 1E.
Figure 1B:
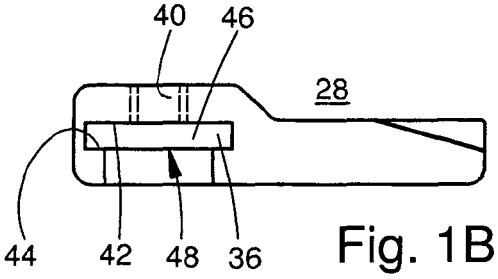
FIG. 1B shows a side view of a rotary latch according to a first embodiment form of the invention.
Figure 1A:
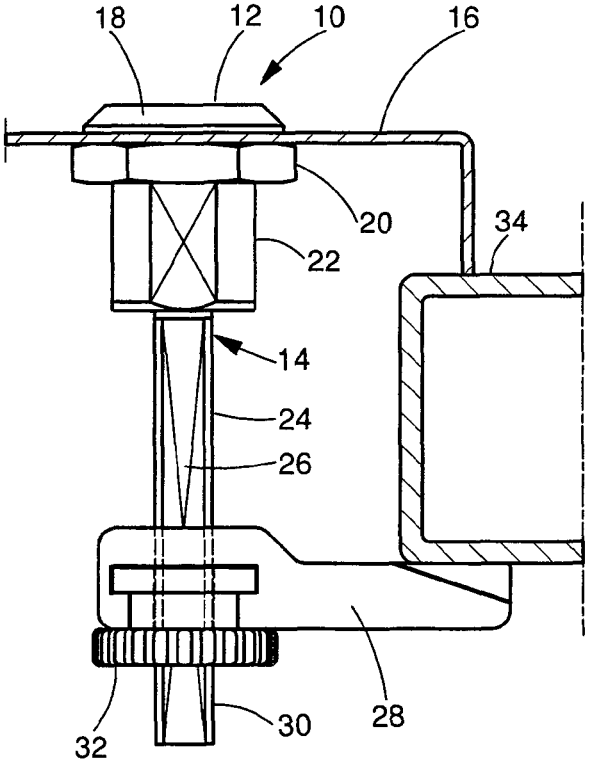
FIG. 1A shows a rotary latch closure installed in a cabinet door which is held by a cabinet frame.

The present invention will now be described in detail on the basis of exemplary embodiments FIG. 1A shows a rotary latch closure 10 comprising a housing 12 with an actuating shaft 14 which is mounted so as to be rotatable but axially fixed therein. The housing is inserted through an opening at a door leaf 16 up to a flange 18 and is held by means of a retainer nut 20 which is screwed onto an external thread 22 of the housing 12 and holds the housing in the door leaf. It is also possible to fasten the housing to the door leaf in other ways, for example, by means of a clip fastener or a spring that can be inserted from the side.

The actuating shaft 14 has a circumferential thread 24 and an axially oriented flattened portion 26. A rotary latch 28 is fitted to the end 30 of the shaft 14 and, with a necked-down portion at one location together with the flattened portion of the shaft, is fixed with respect to relative rotation but, on the other hand, is displaceable in axial direction on the shaft. The rotary latch 28 is supported in the direction of the end of the shaft 30 by a knurled nut 32 such that by screwing in the nut the rotary latch 28 is fixed, e.g., in direction of the door frame 34, by the knurled nut, and the latch 28 is accordingly fixed in direction of the door leaf 16, whereas, in the opposite direction, the latch is held by ring arrangement 38 proceeding from the knurled nut 32, which ring arrangement 38 engages in a corresponding annular groove 36 of the knurled cam. As can be seen from FIG. 1D and FIG. 1E, the knurled nut 32 with the ring 38 can be inserted laterally into the cam 28, whereupon the shaft 14 can be inserted through the opening 38. By turning the knurled nut 32, the cam 28 can be displaced axially in both directions in order to ensure a snug contact of the latch 28 at the frame 34.

Accordingly, in this embodiment form, part of the nut 32, namely, the ring 38, is enclosed by a cage 48 which forms a space 46 which is accessible from the side (see FIG. 1D) and which is bounded by two walls 42, 44 which have a prismatic opening in each instance so that the opening allows the shaft to be slid through in a torsionally rigid manner.

Figure 2B:
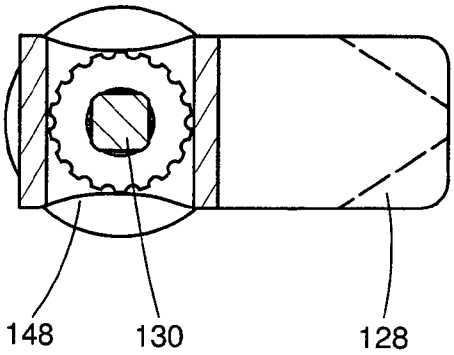
FIG. 2B shows a side view of the other embodiment form of the invention from the rear.
Figure 2A:
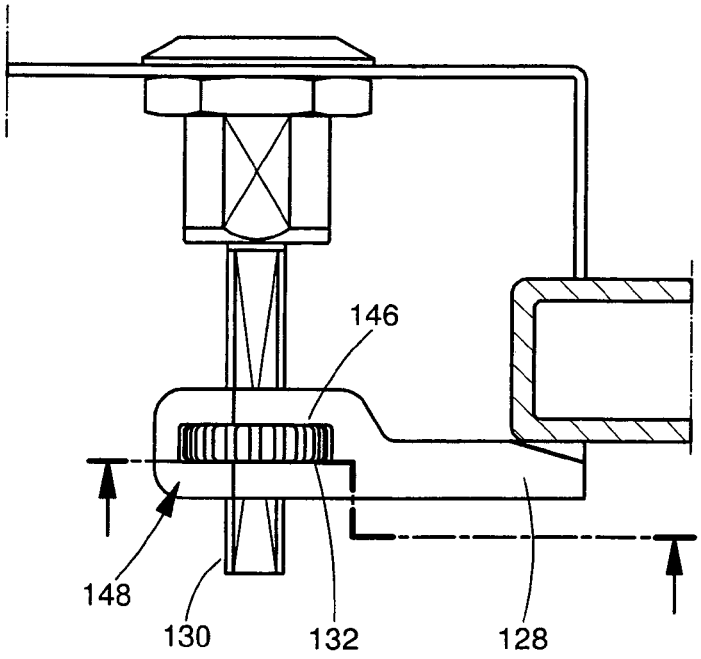
FIG. 2A shows a side view of another embodiment form of the invention in partial section.
Figure 2C:
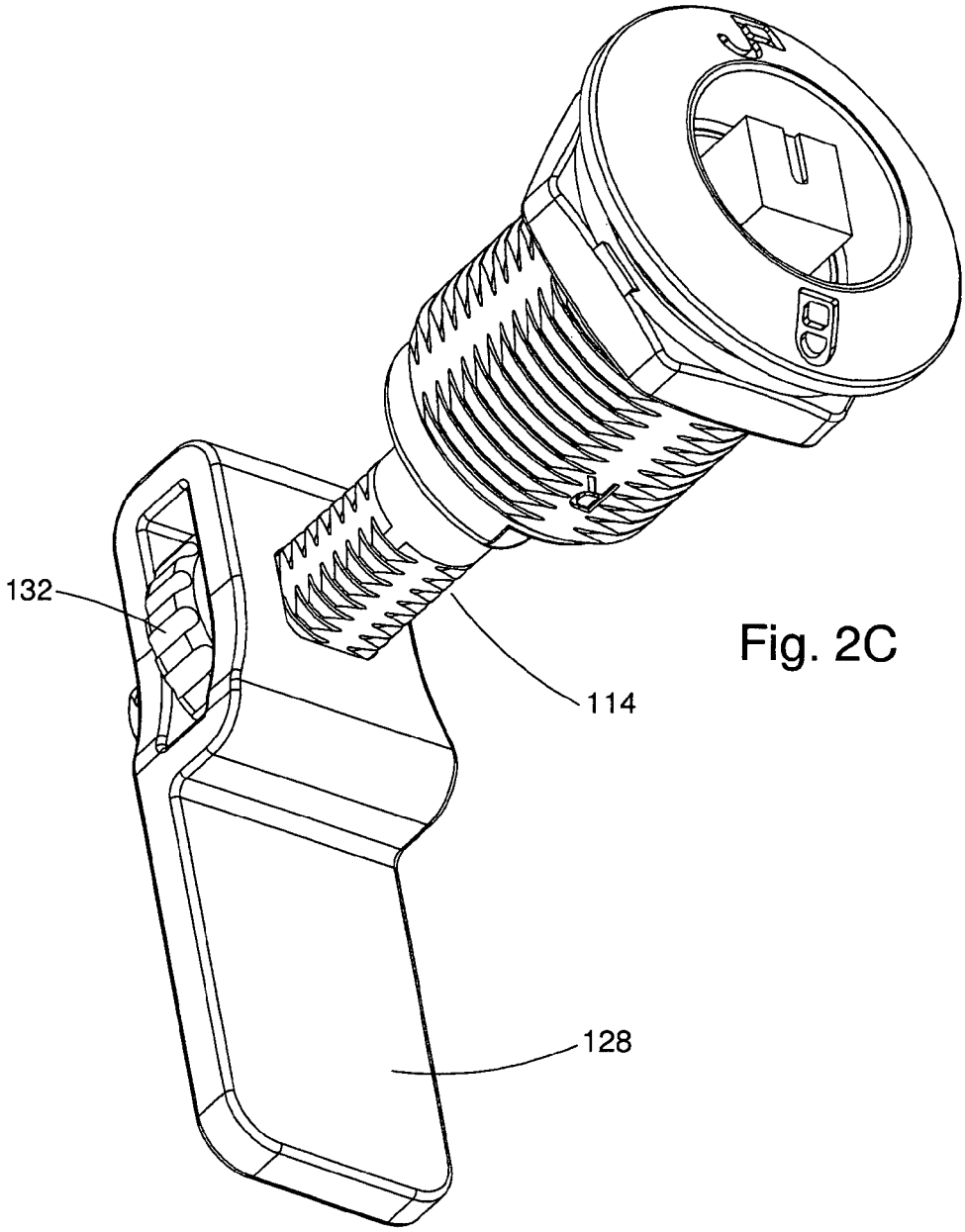
FIG. 2C shows a perspective view of this closure.
Figure 2D:
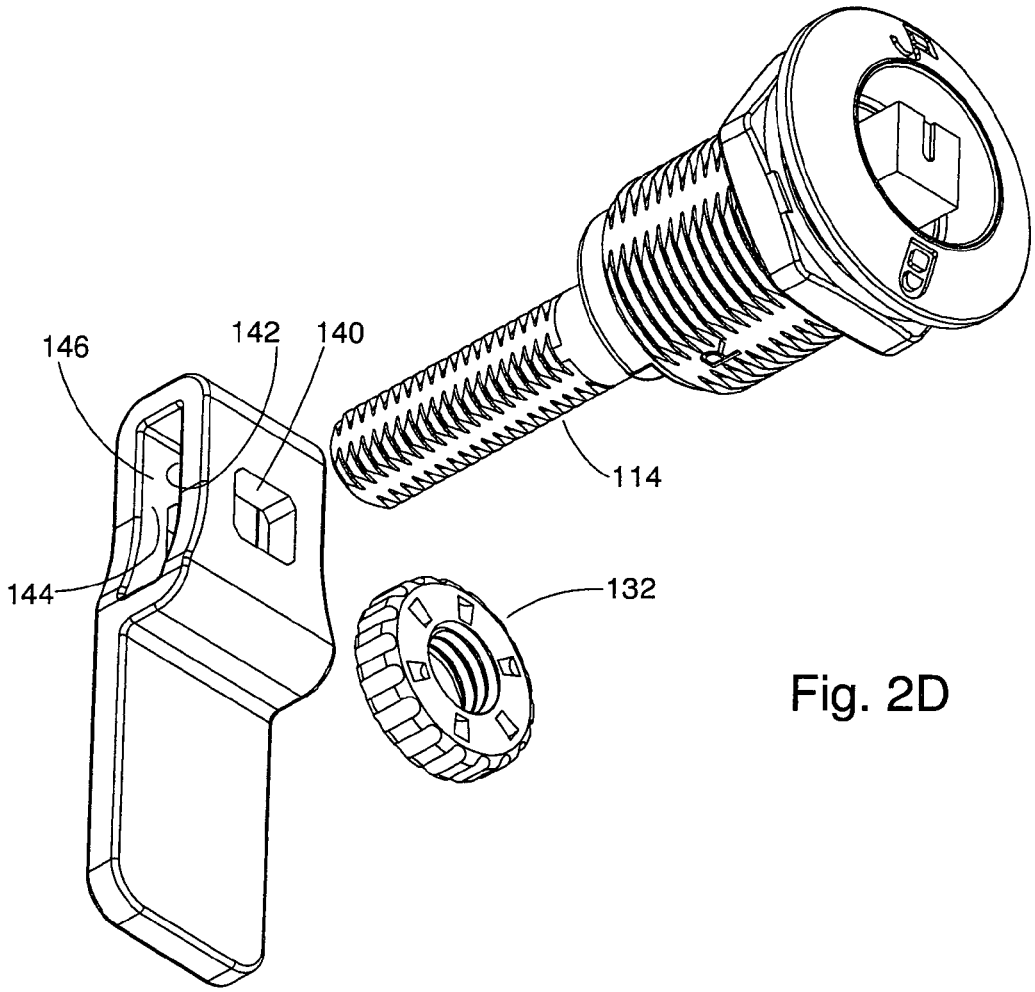
FIG. 2D shows an exploded view of this embodiment form according to FIG. 2C.
Figure 2E:
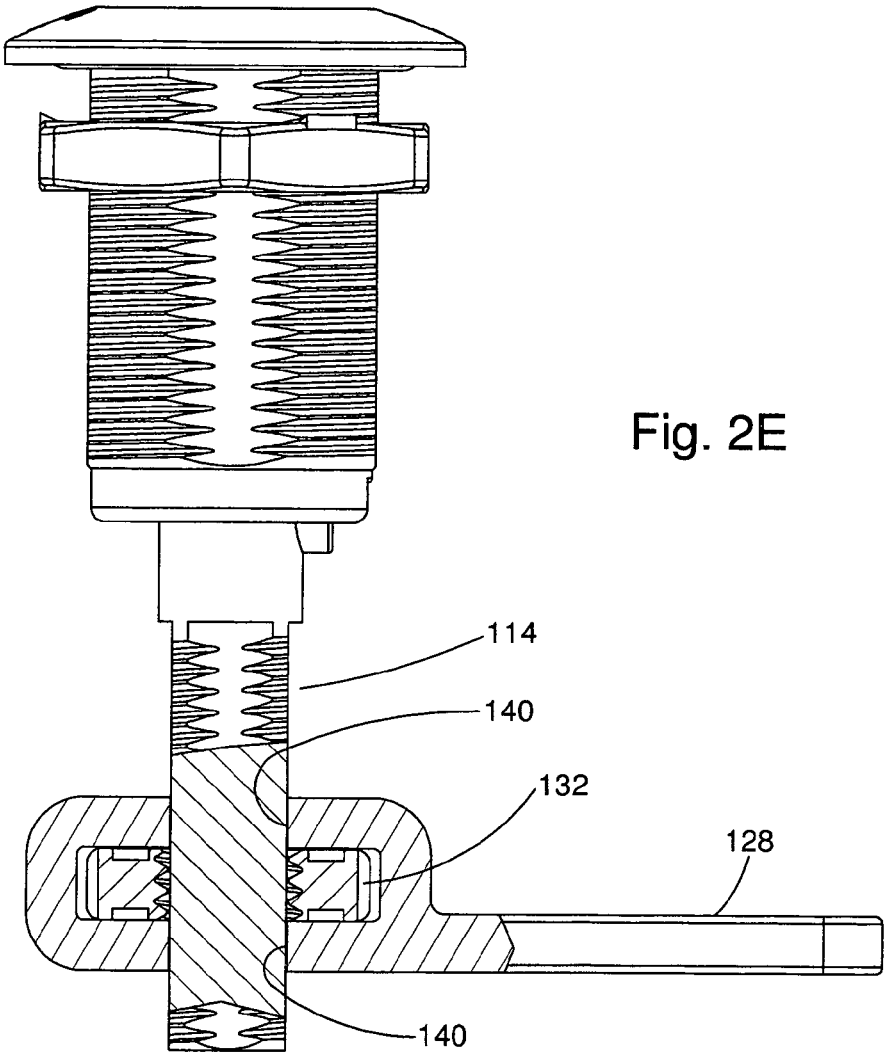
FIG. 2E shows a side view of this embodiment form.

The cage 48 surrounding the annular groove 36 is integral with the latch cam 28. In the embodiment form in FIG. 2A, the knurled nut 32 is also slid in laterally, whereupon the shaft with its thread can be inserted through the openings 140 in the walls 142, 144 and the nut 132 can be turned at the same time.

Figure 3A:
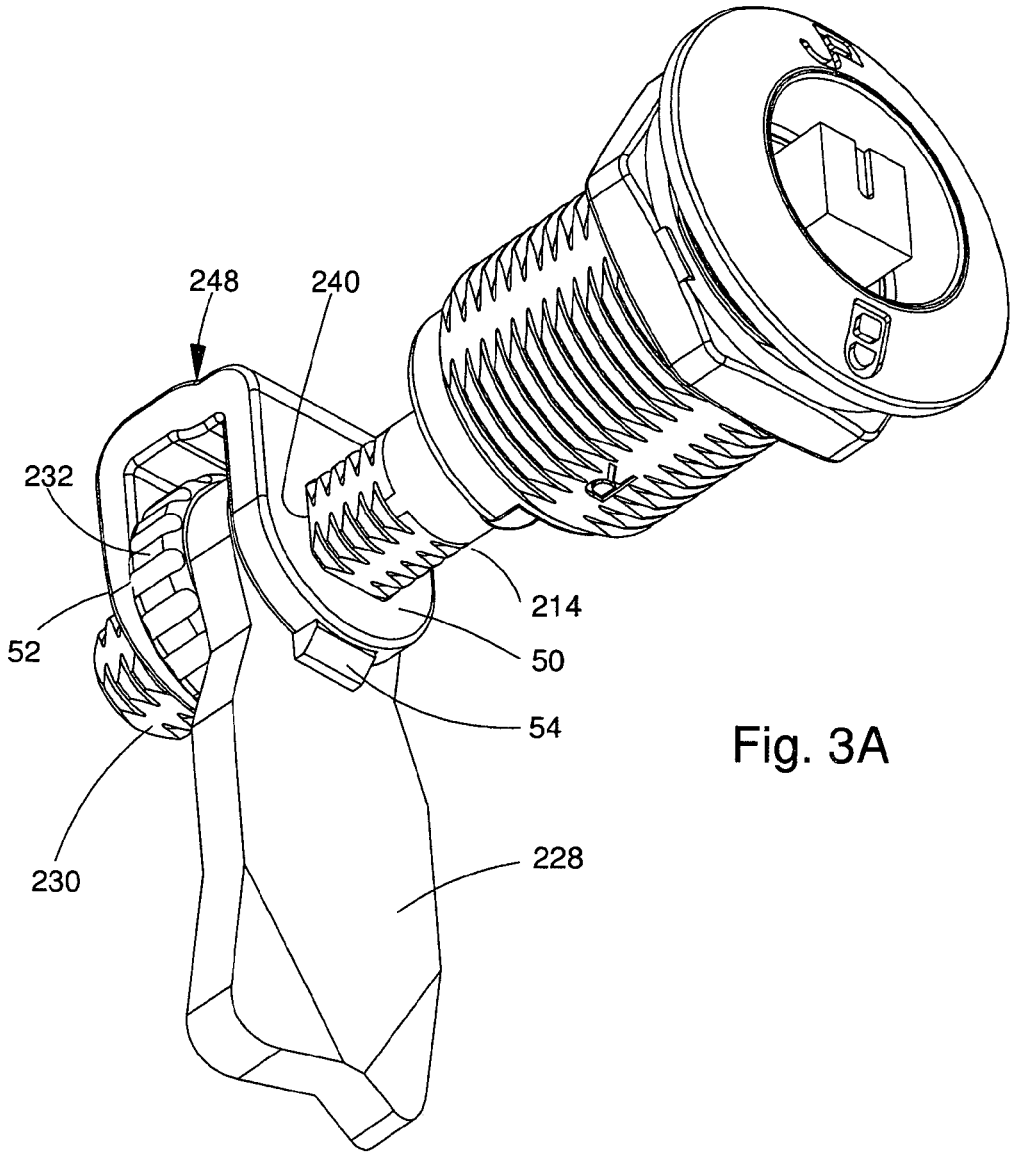
FIG. 3A shows a perspective view of another embodiment form of the invention.

It can be seen in the embodiment form shown in FIG. 3A that the cage and the latch cam 228 are two parts. Accordingly, the cage 248 and the latch cam 228 can be made from different materials, e.g., plastic and metal. FIG. 3A also shows that the cage is U-shaped in this case, and the walls form the U-legs through which prismatic (particularly rectangular) bores 45 are guided in order to receive the shaft while preventing rotation. The latch 228 is likewise connected to the shaft 45 in a torsionally rigid manner.

Figure 3B:
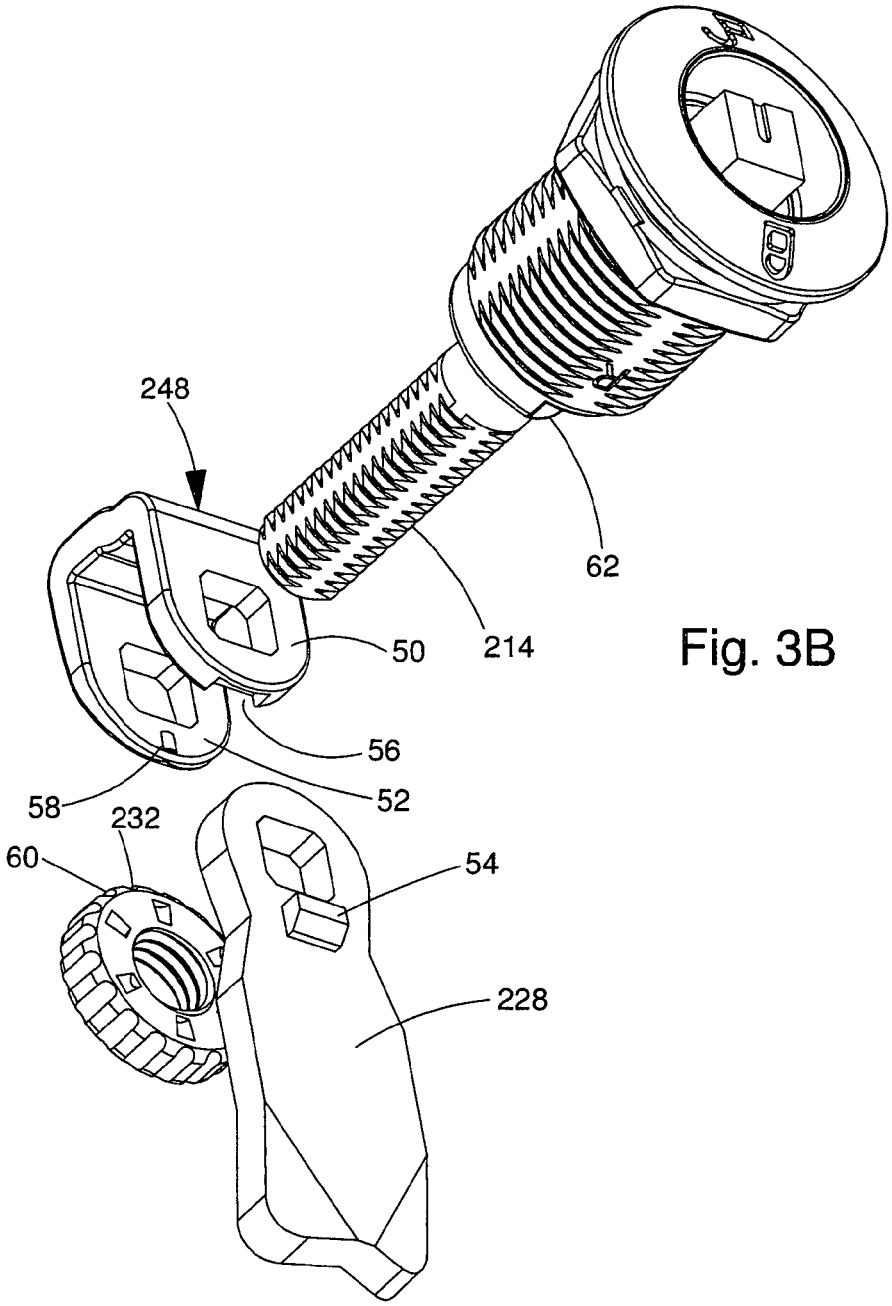
FIG. 3B shows an exploded view of the latter embodiment form.
Figure 3C:
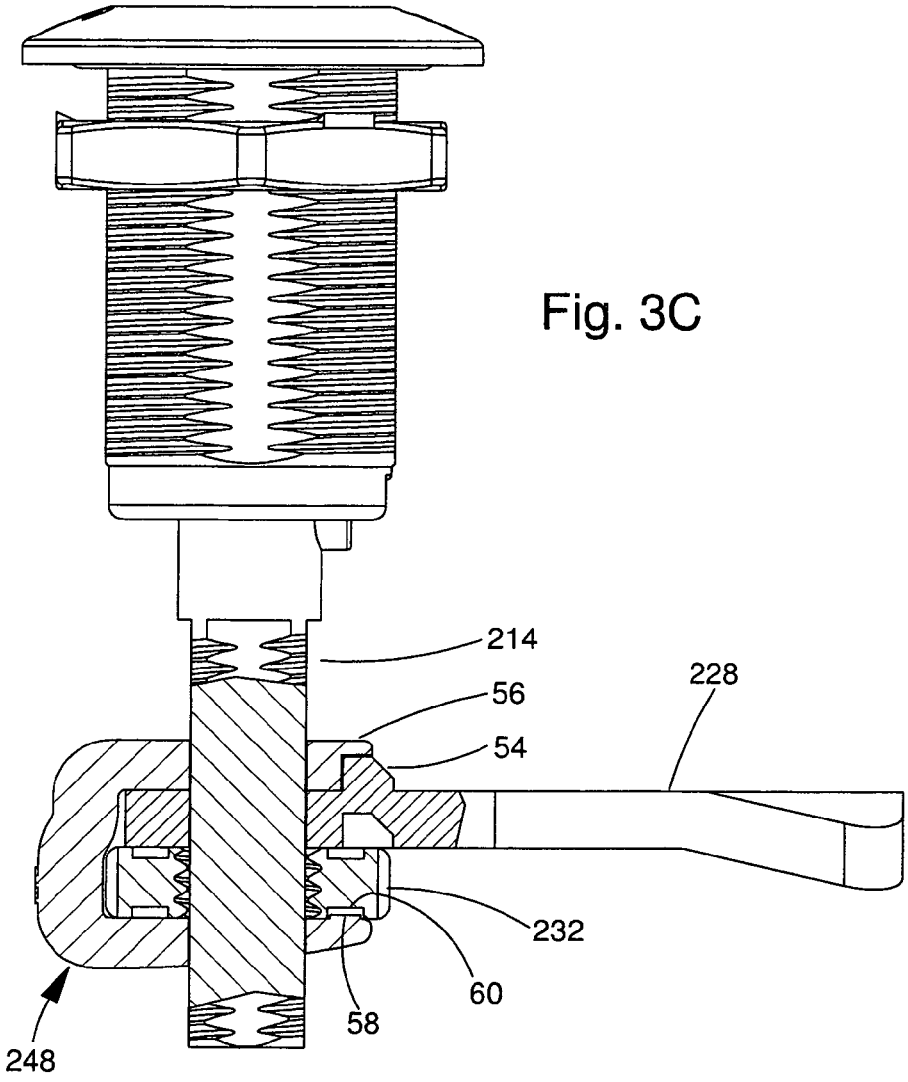
FIG. 3C shows a side view of this rotary latch closure.

Further, the latch 228 can be provided with a protuberance or recess. FIG. 3B shows that the cage is not only U-shaped and that the walls form U-legs (see reference numerals 50, 52) but also that the one leg 50 of the U-shaped cage forms a recess 56 close to its free end in which a projection 54 of the rotary latch 228 can be received in a positive engagement and accordingly produces a positively engaging rotational connection. The other leg 52 of the U-shaped cage forms a knob 58 which engages with recesses 60 in the contacting lateral surface of the nut 232 to prevent rotation. This prevents the knurled nut 232 from unwanted adjustment, e.g., during shaking movement.

As can be seen from FIG. 3B, the cage 248 is also U-shaped, and the nut 228 together with the rotary latch can be slid in along the axis of the legs of the U-shaped cage.

Figure 4:
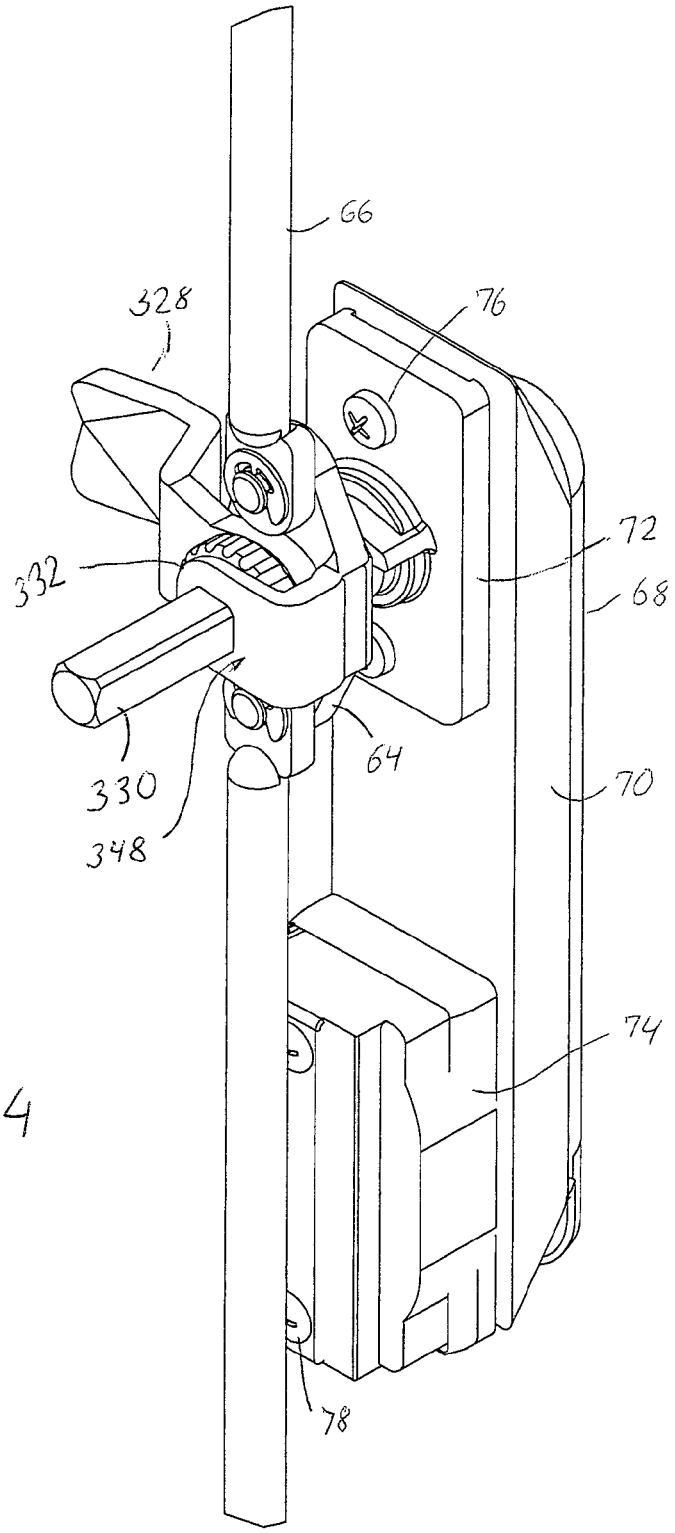
FIG. 4 shows a perspective view of a swivel lever closure according to the invention.

FIG. 4 shows a rotary latch 328 which is axially displaceable by means of a screw 332. Here, also, the nut is arranged in a cage 348 which is bounded by two ends, and the opening allows the shaft to be slid through in a torsionally rigid manner, and the shaft is driven by a swivel lever which propels the cage 348 and, further, has a double-arm. Locking rods are arranged at the arms and can be displaced axially by rotating the shaft 330. The shaft 330 is driven by a swivel lever 68. The swivel lever can be swiveled into a cavity 70 which can be installed in two apertures in the thin wall, specifically with a disk 72 and with a locking cylinder receptacle 74.

Figure 5:
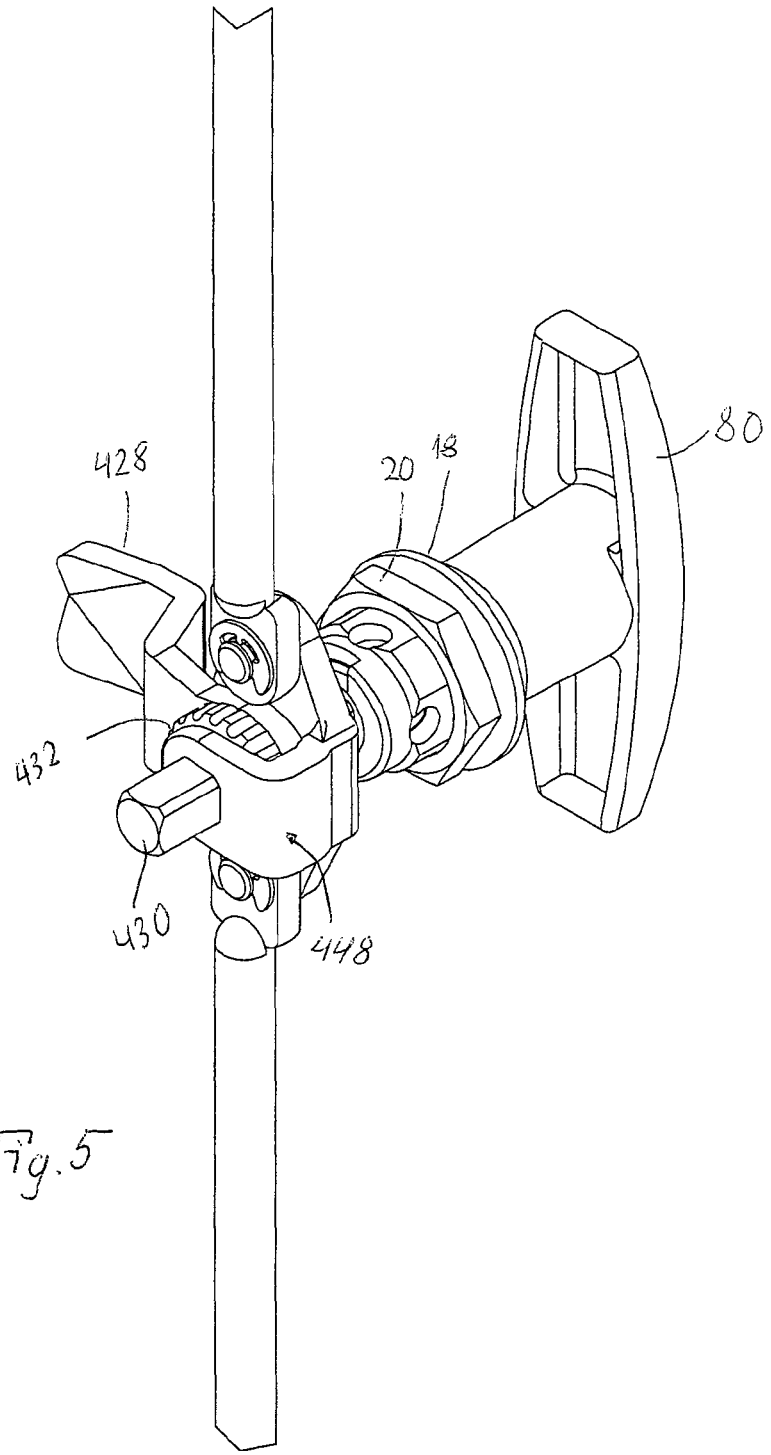
FIG. 5 shows a perspective view of a T-handle.

FIG. 5 shows a perspective view of a closure which has a construction similar to that of the closure shown in FIG. 4 and in which actuation is effected by means of a T-handle 80 which is fastened by means of a retainer nut in conventional manner as is shown in FIG. 1A.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claim.

LIST OF REFERENCE NUMERALS

10 rotary latch closure
12 housing
14, 114, 214 actuating shaft
16 door leaf
18 flange
20 retainer nut
22 circumferential thread of the housing
24 circumferential thread of the shaft
26 flattened portion of the shaft
28, 128, 228
328, 428 rotary latch
30, 130, 230,
330, 430 free end of the shaft
32, 132, 232,
323, 432 knurled nut
34 door frame
36 ring annular groove
38 annular groove ring
40, 140, 240 prismatic bore
42 wall
44, 144 wall
46, 146 space
48, 148, 248,
348, 448 cage
50 U-leg
52 U-leg
54 projection/recess
56 recess/projection
58 knob
60 recesses
62 cam path
64 double-lever
66 lock rods
68 swivel lever
70 cavity
72 clamping plate
74 cylinder lock receptacle
76 clamping screw
78 clamping screw
80 T-handle

The invention claimed is:

1. A rotary latch closure apparatus comprising:

a housing including:

an actuating shaft configured to be mounted so as to be rotatable but axially fixed therein, the actuating shaft comprising, at its free end;

a circumferential thread; and at least one axially oriented flattened portion;

a nut configured to be screwed onto the circumferential thread; and a rotary latch configured to be fitted to the free end of the shaft so as to be fixed with respect to rotation relative to it in at least one rotational position and axially supported on the nut; and wherein:

the nut comprises:

a single unit along an axial direction enclosed by a cage configured to form a laterally accessible space bounded by two walls;

wherein each of the two walls is perpendicular to an axis of the nut when the single unit is enclosed by the cage, the two walls having a distance from one another in an axial direction of the nut that accommodates an axial length of the single unit; and wherein each of the two walls include a prismatic opening that is configured to allow the shaft to be slid through in a torsionally rigid manner; or the nut comprises:

multiple parts along the axial direction comprising a ring arrangement enclosed by a cage configured to form a laterally accessible space bounded by a first wall comprising a prismatic opening and a second wall comprising a U-shaped notch or recess configured to receive the ring arrangement;

wherein each of the first and second walls is perpendicular to an axis of the nut when the ring arrangement is enclosed by the cage, the first and second walls having a distance from one another in an axial direction of the nut that accommodates an axial length of a portion of the ring arrangement.

2. The rotary latch closure apparatus according to claim 1; wherein the cage is integral with the rotary latch.

3. The rotary latch closure apparatus according to claim 1; wherein the cage and the rotary latch are two parts.

4. The rotary latch closure apparatus according to claim 3; wherein the cage is U-shaped; and first and second U-legs form the first and second walls.

5. The rotary latch closure apparatus according to claim 4; the first U-leg of the U-shaped cage forms a recess or projection near its free end configured to receive the rotary latch in a positive engagement.

6. The rotary latch closure apparatus according to claim 4; the second U-leg of the U-shaped cage forms a knob configured to engage with recesses of a contacting lateral surface of the nut in order to preventing rotation.

7. The rotary latch closure apparatus according to claim 1; wherein the nut includes a circumferential knurling.

8. The rotary latch closure apparatus according to claim 7; wherein the walls of the cage are configured to retract transverse to an extension of the rotary latch and configured to make the circumferential knurling of the nut accessible.

9. The rotary latch closure apparatus according to claim 4; wherein the nut together with the rotary latch are configured to be inserted into the cage along an axis of the U-legs.

10. The rotary latch closure apparatus according to claim 1;

wherein the rotary latch is configured to be driven by a swivel lever.

11. The rotary latch closure apparatus according to claim 1;

wherein the rotary latch is configured to be driven by a T-handle.

* * * * *